US006888115B2

(12) United States Patent
Drozd

(10) Patent No.: US 6,888,115 B2
(45) Date of Patent: May 3, 2005

(54) CASCADED PLANAR EXPOSURE CHAMBER

(75) Inventor: J. Michael Drozd, Raleigh, NC (US)

(73) Assignee: Industrial Microwave Systems, L.L.C., Morrisville, NC (US)

( * ) Notice: Subject to any disclaimer, the term of this patent is extended or adjusted under 35 U.S.C. 154(b) by 0 days.

(21) Appl. No.: 10/276,727

(22) PCT Filed: May 21, 2001

(86) PCT No.: PCT/US01/16249

§ 371 (c)(1),
(2), (4) Date: Jun. 25, 2003

(87) PCT Pub. No.: WO01/91237

PCT Pub. Date: Nov. 29, 2001

(65) Prior Publication Data

US 2004/0027303 A1 Feb. 12, 2004

Related U.S. Application Data

(60) Provisional application No. 60/205,256, filed on May 19, 2000.

(51) Int. Cl.[7] ..... H05B 6/70
(52) U.S. Cl. ..... 219/701; 219/696
(58) Field of Search ..... 219/701, 699, 219/744, 694, 750, 757, 693, 692, 697, 700, 696; 343/786, 725, 771, 753, 778, 768, 770, 772, 776, 756, 782, 783

(56) References Cited

U.S. PATENT DOCUMENTS

| | | | | |
|---|---|---|---|---|
| 3,688,068 A | * | 8/1972 | Johnson | 219/696 |
| 4,517,571 A | | 5/1985 | Mulliner et al. | |
| 5,258,768 A | | 11/1993 | Smith | |
| 5,426,442 A | | 6/1995 | Haas | |
| 5,440,316 A | | 8/1995 | Podgorski et al. | |
| 5,536,921 A | * | 7/1996 | Hedrick et al. | 219/693 |
| 5,552,583 A | * | 9/1996 | Berteaud et al. | 219/693 |
| 5,557,291 A | | 9/1996 | Chu et al. | |
| 5,959,591 A | | 9/1999 | Aurand | |
| 6,797,929 B2 | * | 9/2004 | Drozd et al. | 219/696 |

* cited by examiner

*Primary Examiner*—Quang T. Van

(57) ABSTRACT

A device for heating relatively wide planar materials is formed by at least two parallel waveguides. Each waveguide has an opening that forms a single opening for a planar material. The planar material is propelled in a direction parallel to the propagation of an electronic wave. If each waveguide is kept in TE mode, heating is uniform across the planar material. Power splitters, septums, tuning stubs, and impedance matching can be used to control the heating in each waveguide.

20 Claims, 5 Drawing Sheets

CASCADED PLANAR EXPOSURE CHAMBER

This application claims the benefit of Provisional application Ser. No. 60/205,256, filed May 19, 2000

FIELD OF INVENTION

This invention relates to electromagnetic energy, and more particularly, to rapid and continuous drying of a planar material.

BACKGROUND

In U.S. Pat. No. 5,958,275, a planar material is passed through a serpentine wave guide that has more than one straight segment The planar material is passed in a direction that is perpendicular to the propagation of an electromagnetic wave in each straight segment. The planar material is passed through a series of diagonal openings to account for attenuation of the electromagnetic wave.

In Metaxas et al, "Industrial Microwave Heating," Peregrinus on behalf of the Institution of Electrical Engineers, London, United Kingdom and co-pending and co-assigned application# 09/372,749, a planar material is passed in a direction parallel to the propagation of the electromagnetic wave. In Metaxas and the '749 application, it is preferable to keep the electromagnetic wave in $TE_{10}$ mode so that there is a peak half way between the top conducting surface and the bottom conducting surface. In Metaxas and the '749 application, the width of the exposure region is limited by the size of the waveguide. In order to dry carpets, rugs, or other relatively wide materials, the waveguide would have to be prohibitively tall. There is a need for an exposure chamber that can be used to rapidly and continuously heat relatively wide materials.

SUMMARY

A device for heating relatively wide planar materials is formed by at least two parallel waveguides. Each waveguide has an opening that forms a single opening for a planar material. The planar material is propelled in a direction parallel to the propagation of an electromagnetic wave in each waveguide. If each waveguide is kept in $TE_{10}$ mode, heating is uniform across the planar material. Power splitters, septums, tuning stubs, and impedance matching can be used to control the heating in each waveguide.

BRIEF DESCRIPTION OF THE DRAWINGS

The foregoing, and other objects, features, and advantages of the invention will be more readily understood upon reading the following detailed description in conjunction with the drawings in which.

DETAILED DESCRIPTION

Figure 1:
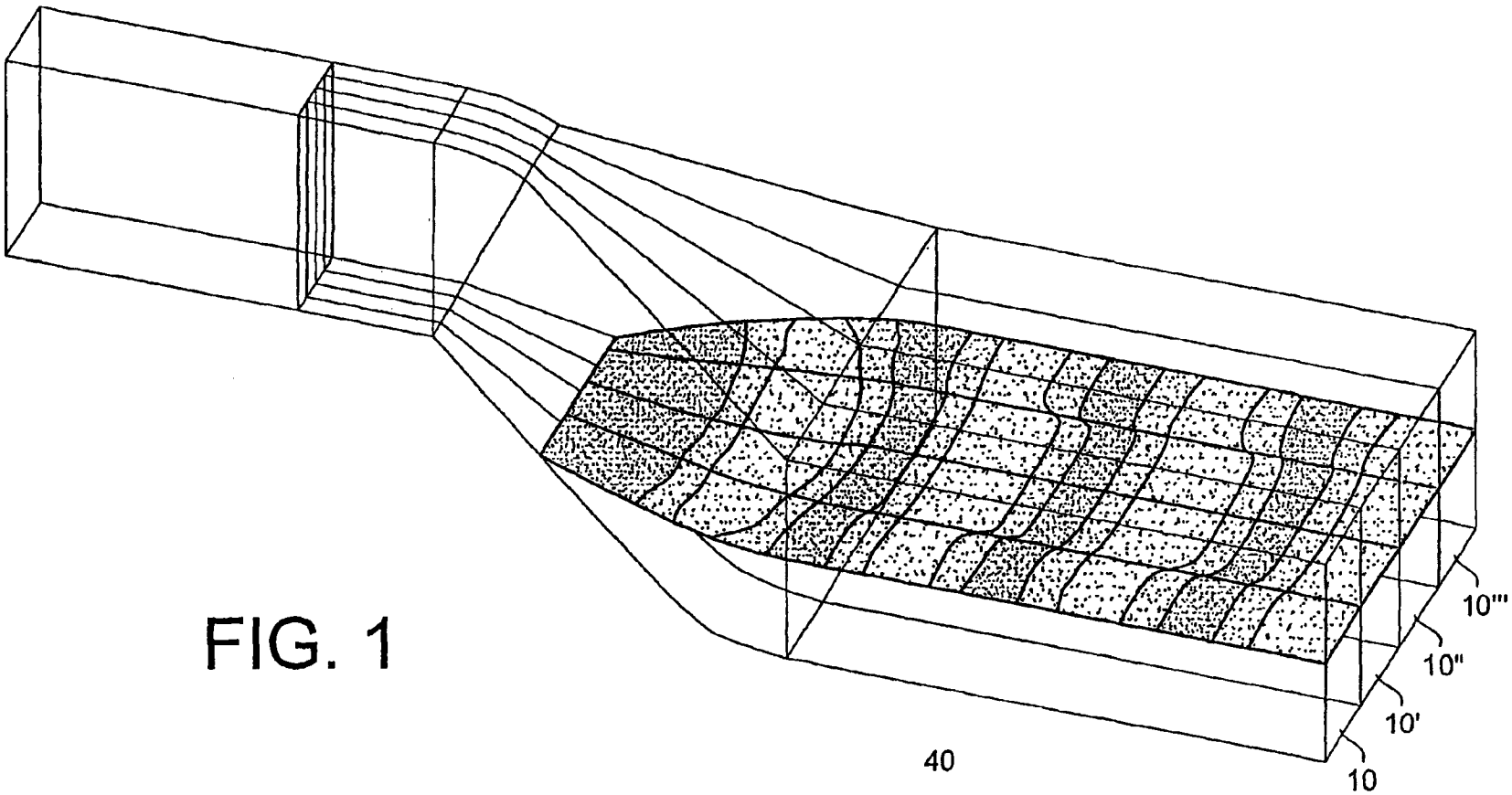
FIG. 1 is an example of a cascaded planar exposure chamber.

In the following description, specific details are discussed in order to provide a better understanding of the invention- However, it will be apparent to those skilled in the art that the invention can be practiced in other embodiments that depart from these specific details. In other instances, detailed descriptions of well-known methods and circuits are omitted so as to not obscure the description of the invention with unnecessary detail.

Utilizing the techniques described below, it is possible to create an exposure region for planar materials of virtually any width. The material can be exposed to a uniform energy distribution or virtually any pre-specified energy distribution across the width of the material. In an exemplary embodiment, individual chambers are juxtaposed (or cascaded). Or alternatively, the chamber is extended to create a wider exposure region. In either case, the material 20 is passed through the chamber 10 in a z direction parallel to the propagation of the electromagnetic wave.

In the cascaded planar exposure chamber design 40, a series of individual chambers 10 are in direct contact or in close proximity. Power into the series 40 of individual chambers 10 can be provided by a single chamber 12 (or more specifically a single waveguide). Using a power splitter 60, energy can be split into multiple chambers 14 (e.g. such as waveguide power splitter) and then into each individual exposure chamber 10. The power splitter 60 could be as simple as placing septums 62 into the single waveguide 12 parallel to the broad wall 13 of the waveguide 12. Using these power splitters 60 may require impedance matching to insure maximum transfer of power to each individual chamber 14.

In the cascaded planar exposure chamber 40, it is possible to design each individual chamber 10 so that only the $TE_{10}$ mode is supported in each individual chamber 10 (i.e. waveguide in this case). This is not a necessity, but does give the advantage that the distribution of energy is well known and controllable. The material is fed through this structure 40 along the length of the chamber. If materials 20 passes through the entire structure 40, the structure 40 will have openings 30 between individual chambers 10 for the material Thus, between each individual chamber 10 there will be a gap 30 due to either metal thickness or an intentional gap. This gap 30 is herein referred to as a septum 62. The distance between the top septum 67 and the bottom septum 65 will typically be small enough to allow the material 20 to pass through. In the septum gap 30, microwave field lines will tend to extend to connect the field lines from one chamber 10 to the adjoining chamber 10. The narrower the septum gap 30, the more this will occur, and thus the more uniformity across the material 20. However, there will be a large field intensity built up at the edge 63 and 64 of the septum 65 and 67 particularly when the septum gap 30 is narrow. This will cause high energy zones in the materials 20 in the gaps 30 between the chambers 10. This effect can be reduced or eliminated by placing a low loss dielectric material 20 such as Teflon on the edge 63 or 64 of the septum 65 or 67.

Material 20 can be fed through the structure 40 either through the middle of the structure 40 or at an angle (making an angle along the length of the structure). If each individual chamber 10 is in $TE_{10}$ mode, then the maximum energy will be in the center of the chamber 10. If the material 20 is placed in the middle of the structure 40, the material 20 near the generator will experience the maximum energy intensity. Because the material 20 causes the wave to attenuate, the energy intensity will decrease in the material 20 further from the generator. This approach is acceptable for materials 20 that can absorb the maximum amount of energy available. At the same time, there are cases where the material 20 cannot accept a high field intensity and the energy should be introduced gradually into the material 20. A simple example of this is a curing process. Likewise, there are examples where the material 20 needs to be initially hit with a large field intensity and then be exposed to a small amount of energy. This would be true in the case where a material 20 needed to brought up to temperature quickly and then maintained at some temperature. Creating an angle to which the material passes through the chamber can accommodate both of these cases. Or more generally, one can place the material 20 at an off peak zone of energy distribution in one or more locations in the chamber. See, for example, U.S. Pat. No. 5,958,275 or U.S. patent application Ser. No. 09/372,749.

In the preferred embodiment, the distribution of energy in each individual chamber 10 would be a rectangular waveguide 10 operating in the $TE_{10}$ mode. The material 20 would either pass through the center of this chamber 40 along the direction of the waveguide 10 or pass through the chamber at an angle but still in the direction of the waveguide 10. Each individual chamber 10 would be tuned so that the maximum amount of energy would be allowed to transmit. The system would be fed by a single waveguide 10 which operates in the $TE_{10}$ mode. The power would be split into each chamber 10 equally. It is also preferable, but not necessary, that each component 10 after the power split is in phase. The result of this would be that the material 20 is uniformly exposed across the width of the material 20. In this embodiment, septum gaps 30 would need to be made as narrow as possible and dielectric barriers would be used to minimize or eliminate hot spot zones directly under the septum edges 63 and 64. The material 20 can be placed either in the center of the chamber 40 or some off peak zone at some point in the chamber 40. The placement will be depend on what is required for the process in terms of a temporal heating profile for the material 20.

Figure 2:
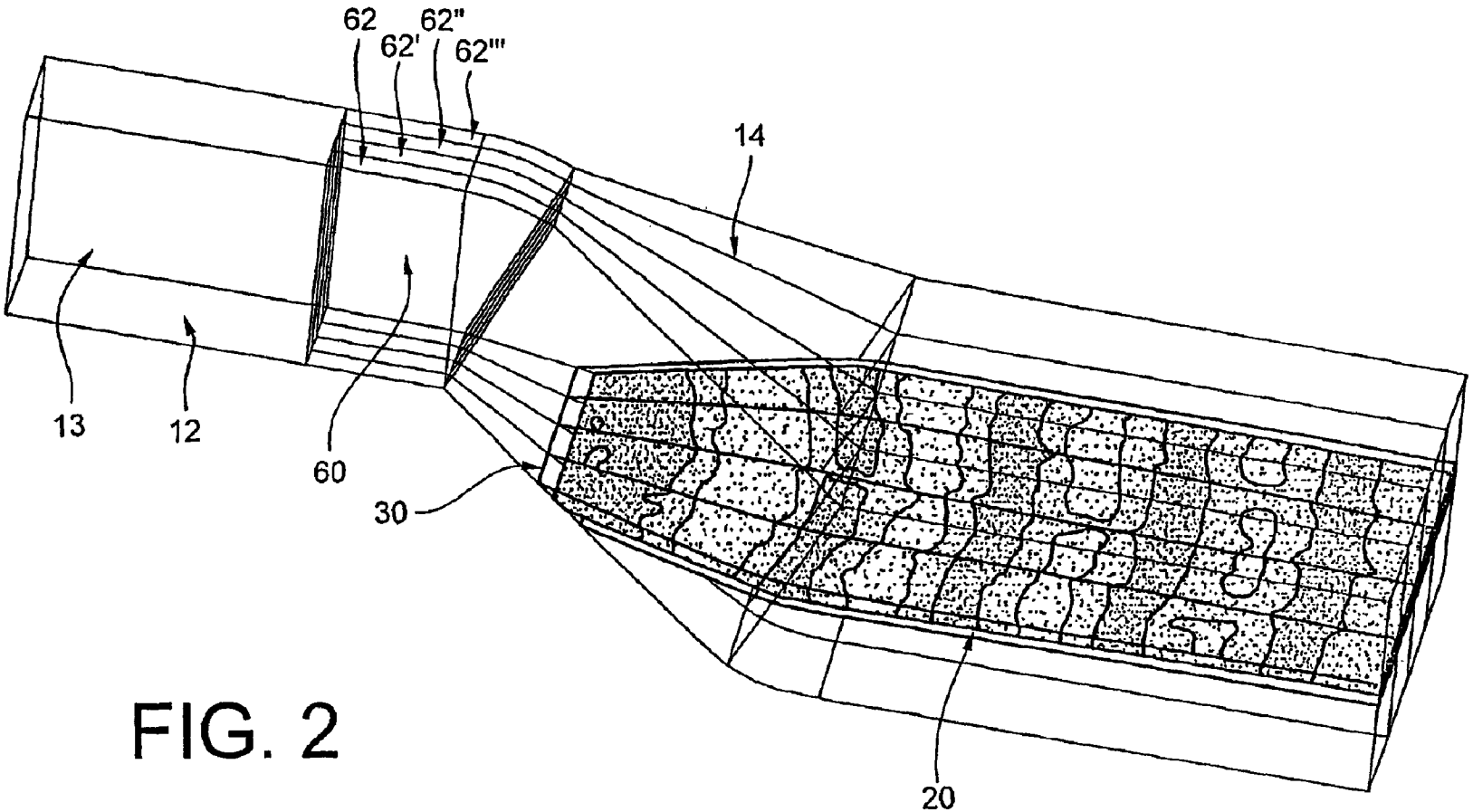
FIG. 2 is an illustration of a planar material being passed through a cascaded planar exposure chamber.

FIG. 1 shows a simple embodiment of the invention. In FIG. 1, one waveguide 10 is split into four waveguide sections 10 that are side by side. FIG. 2 shows that the same embodiment with material 20 placed in the center of the chamber 40. In FIG. 2, each individual chamber is maintained in $TE_{10}$. Notice that uniformity is created across the width of the material 20.

Figure 3:
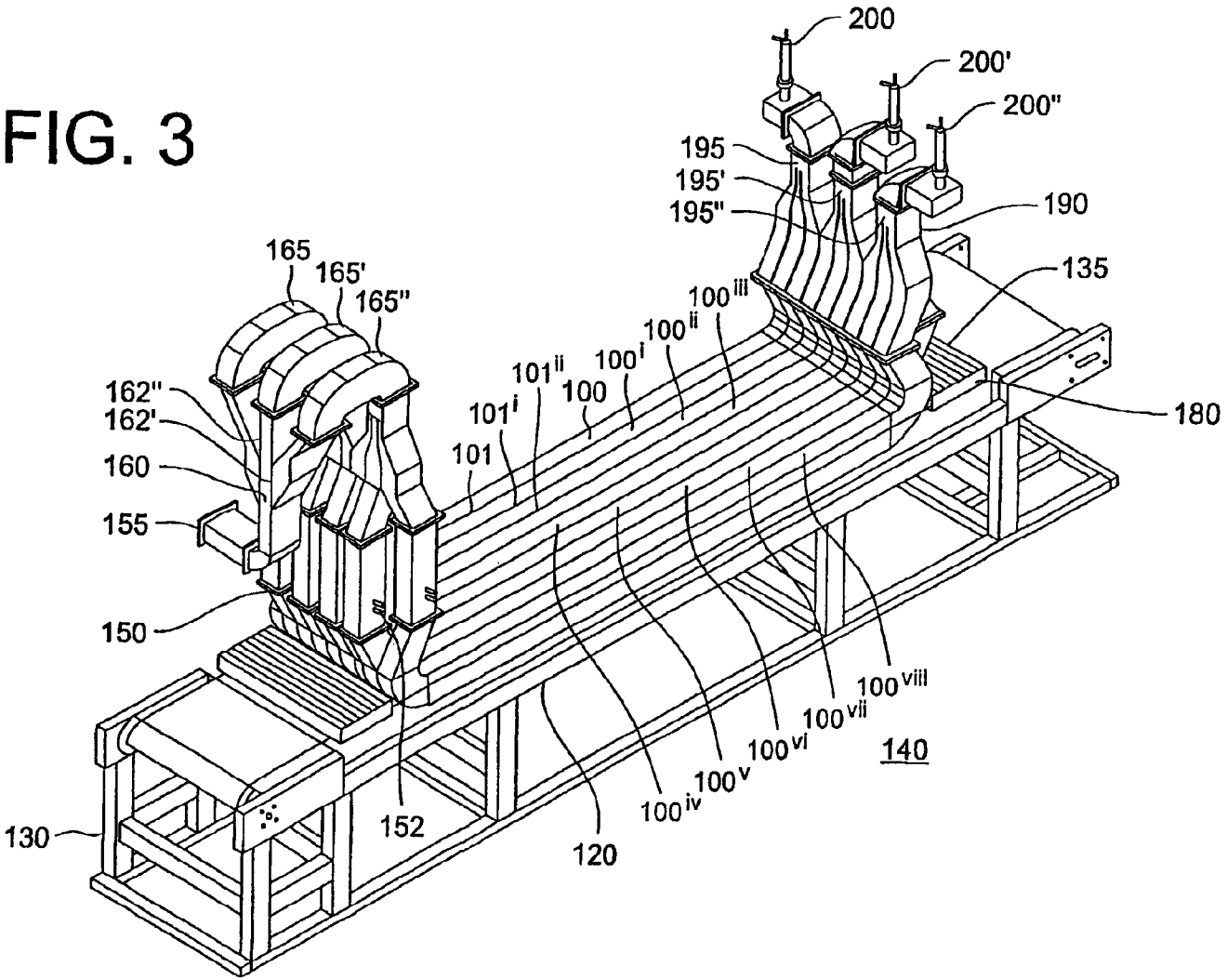
FIG. 3 is another example of a cascaded planar exposure chamber.

FIG. 3 shows a more involved embodiment that highlights many of the aspects of the invention. In FIG. 3, energy is launched into the chamber 140 through a generator into a rectangular waveguide 155 operating in the $TE_{10}$ mode. This initial waveguide 155 is split into three equal and in phase components 165 all in $TE_{10}$ mode using a power splitter 160 with septums 162 inside of a waveguide 160. Each of the three waveguides 165 is then split into three additional individual waveguides 100 (a three-to-nine power splitter 170) all in $TE_{10}$ mode. These individual waveguides 100 are cascaded to form a chamber 40 of individual chambers 100 separated by a narrow septum 101. The transition between the nine waveguides 100 and the body of the chamber 120 is curved to minimize reflections. Material 20 is passed through the resulting cascaded planar exposure chamber 120. In this case, the material 20 is passed through the center of the chamber 120. Chokes 180 are used at the material entrance 130 and exit 135 of the system 140 to reduce leakage to acceptable levels. At the exit end 135 of the chamber 140, the individual chambers 100 are recombined into three waveguides 195 using a nine-to-three power combiner 190. These three waveguide sections 195 are then terminated in a water/absorbing load 200. This creates a traveling wave in the chamber 140.

As a final concept, with the cascaded planar exposure chamber 140, it is possible to vary the amount of energy in each individual chamber 100. Thus, it is possible to create virtually any heating pattern across the width of the material 20. This would be practical if one wanted to heat the center of the material 20 different from the edges of the material 20. For example, if there was a strip on the edge of a fabric that was thicker than the center of the fabric, one may want to put more energy into the outer chambers $\mathbf{100}^{vii}$ and $\mathbf{100}^{viii}$ and less in the center chambers $\mathbf{100}^{iii}$ and $\mathbf{100}^{iv}$. There are two primary ways to create an unequal split of energy. First, the stub tuners 150 could be used to create imperfect matches in the chambers that did not need as much energy. Second, the power splitter 160 could be designed to create an unequal split.

Figure 4:
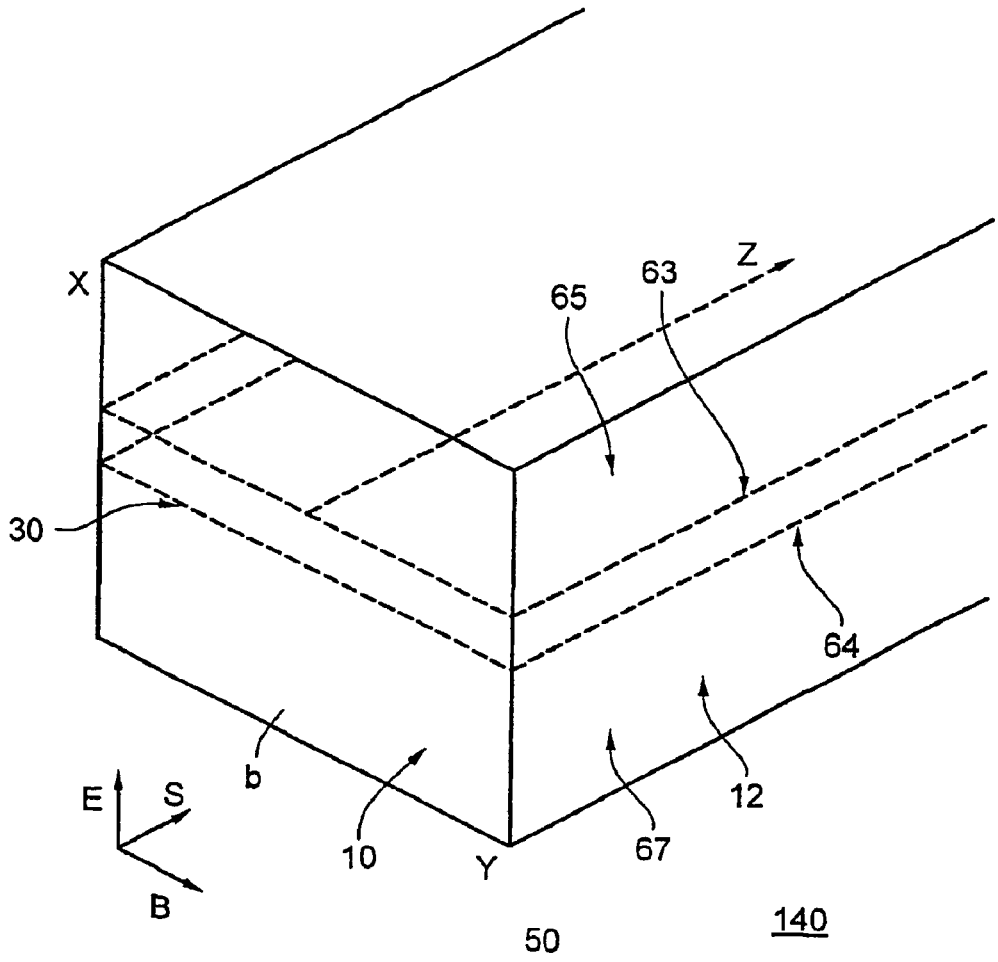
FIG. 4 is an example of an extended planar exposure chamber.

FIG. 4 is an illustration of an extended planar exposure chamber. In FIG. 4, the height x of a $TE_{10}$ waveguide is kept constant, but the exposure width y is extended. The effect of simply widening the exposure region is that modes beyond $TE_{10}$ are generated. If the height x is not changed from the standard curing chamber 10, then the only modes that are created are across the exposure width y. As a result, energy is still highest in the center of the chamber 10 but hot and cold spots appear along the exposure region. However, by staggering these hot and cold spots, it may be possible to create uniformity as the material 20 passes through the chamber 10. Also, using a dielectric wheel placed in the chamber 10 could help increase uniformity across the width y of the chamber 10. This embodiment is not as robust as the cascaded planar exposure chamber 40, but it is easier to build.

The primary advantage of a cascaded planar exposure chamber 40 or an extended planar exposure chamber 140 is that it is possible to create a uniform energy distribution across the width y of a planar material 20. The cascaded planar exposure chamber 40 or 140 in particular will create a uniform energy distribution across the width y of virtually any material 20. Thus, the system 40 or 140 can handle virtually any material. Moreover, it is possible to create any heating pattern across the width y of the material 20 by varying the power in each individual chamber 10.

Figure 5:
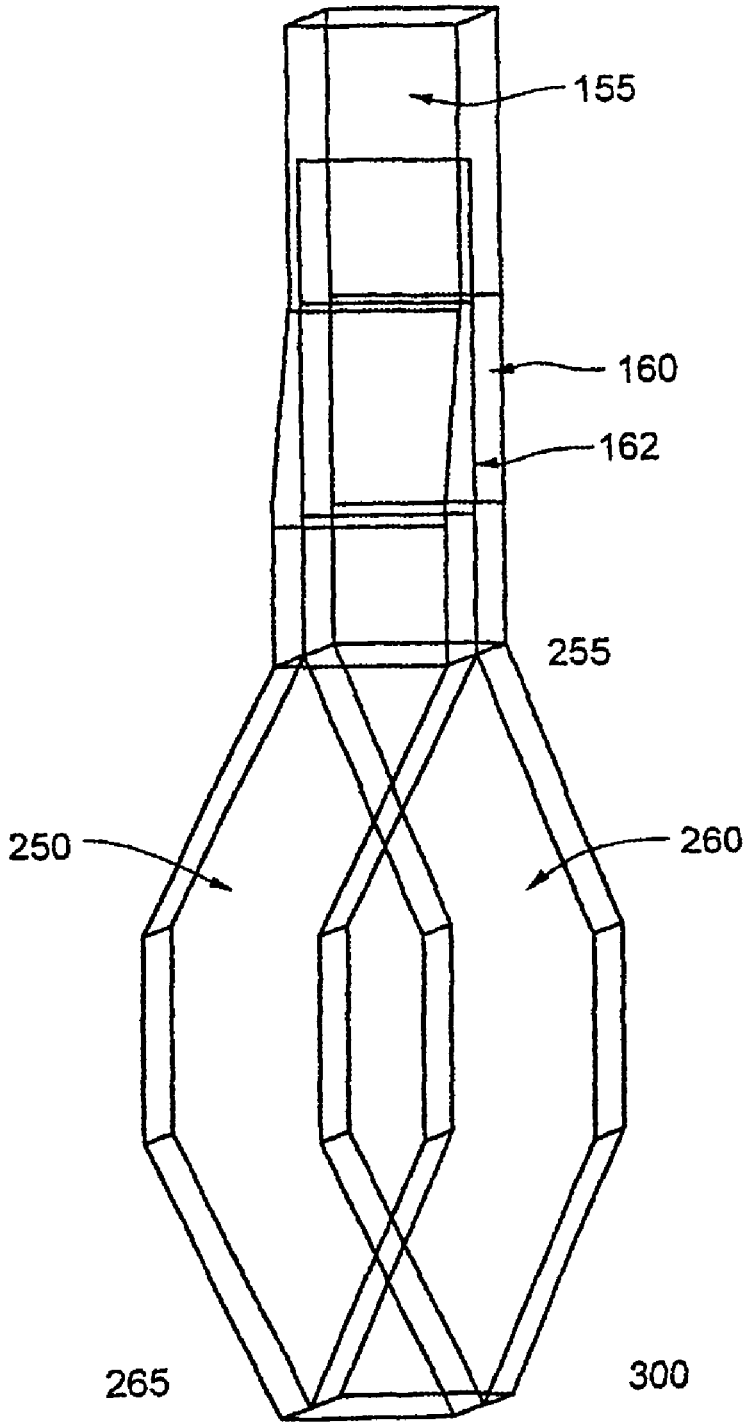
FIG. 5 is an example of a staggered waveguide structure.

FIG. 5 illustrates a staggered waveguide structure 300. Staggered waveguide structure 3 00 can be positioned in between, for example, the three-to-nine splitter 170 and the exposure chamber 120. Staggered waveguide structure 300 allows access to and/or adjustment of stub tuner 150 and directional coupler 152. Stub tuner 150 allows one to maximize (or optimize) the power in each individual chamber 100. Directional coupler 152 allows one to measure the energy delivered to each individual chamber 100, and thus, determine whether there is an even split of the power after the three-to-nine power splitter 170. Staggered structure 300 provides additional space for stub tuners 150 and directional couplers 152 that might otherwise not be available. Staggered structure 300 comprises a first waveguide 250 and a second waveguide 260, both having a first end 255 and a second end 265. First waveguide 250 bends away from second waveguide 260 at first end 255 such that more space is available for stub tuners 150 and directional couplers 152. First waveguide 250 bends towards second waveguide 260 at second end 265 such that chambers 100 are in direct contact or in close proximity.

In other words, the first waveguide 250 is directed with respect to the second waveguide 260 such that the waveguides 250 and 260 flow away from each other, creating more space for at least one waveguide than if the waveguides were not directed. In other words, the waveguides 250 and 260 begin adjacent to each other and can end up adjacent to each other. In other words, the waveguides 250 and 260 have enough space such that at least one waveguide can have a certain device attached to it where the space was created.

While the foregoing description makes reference to particular illustrative embodiments, these examples should not be construed as limitations. Thus, the present invention is not limited to the disclosed embodiments, but is to be accorded the widest scope consistent with the claims below.

What is claimed is:

1. A device for heating a material, the device comprising:

a rectangular chamber having a firer end and a second end;

a source capable of generating an electromagnetic wave that propagates from the first end to the second end;

an opening at the first end of the rectangular chamber;

a path for a material, the path passing through the opening, the path extending from the first end of the rectangular chamber to the second end of the rectangular chamber; and the width of said path exceeding twice of the cutoff frequency distance of the rectangular chamber, while the length of said path is greater than the cutoff frequency distance of the rectangular waveguide.

2. A device as described in claim 1, the rectangular chamber comprising at least two waveguides, the width of each waveguide less than twice the cutoff frequency of said waveguide.

3. A device as described in claim 2, the electromagnetic wave in each waveguide operating in $TE_{10}$ mode.

4. A device as described in claim 2, the device comprising at least two cascaded waveguides.

5. A device for heating a material, the device comprising:

at least two parallel chambers, each chamber having a first end and a second end;

a first opening at the first end of the first chamber;

a second opening at the first end of the second chamber;

said first opening and said second opening forming a path for a planar material; and said path extending from said first end of each chamber to the second end of each chamber.

6. A device as described in claim 5, the device further comprising:

a source capable of generating an electromagnetic wave; and a power splitter capable of delivering the electromagnetic wave to the first chamber and the second chamber.

7. A device as described in claim 5, the device further comprising:

a third chamber;

a source capable of generating an electromagnetic wave;

a first power splitter and a second power splitter, said first power splitter capable of delivering the electromagnetic wave to the first chamber and the second power splitter; and said second power splitter capable of delivering the electromagnetic wave to the second chamber and the third chamber.

8. A device as described in claim 5, the device further comprising:

a central waveguide having two broad sides and two short sides;

a source, connected to the central waveguide, capable of generating an electromagnetic wave; and at least one septum parallel to the broad sides of the central waveguide dividing the electromagnetic power of the electromagnetic wave between the at least two chambers.

9. A device as described in claim 6, the device further comprising a tuning stub for matching the impedance of the power splitter.

10. A device as described in claim 9, the tuning stub operable to vary the amount of electromagnetic energy delivered to each chamber.

11. A device as described in claim 10, wherein the energy delivered to each chamber is the same.

12. A device as described in claim 8, the at least one septum positioned closer to one of the two broad sides.

13. A device as described in claim 5, a first electromagnetic wave in the first chamber in $TE_{10}$ mode, a second electromagnetic wave in the second chamber in $TE_{10}$ mode.

14. A device as described in claim 5, each chamber having two broad sides and two narrow sides, the path positioned halfway between the two narrow sides.

15. A device as described in claim 13, the path each chamber having a first conductive surface and a second conductive surface, an electromagnetic wave in each chamber creating an electric field between the two conducting surfaces, the path extending through a region that is an off-peak region of the electric field.

16. A device as described in claim 8, the device further comprising dielectric materials on each septum.

17. A device as described in claim 5, the device further comprising a water load at the second end of each chamber.

18. A device as described in claim 6, the device further comprising:

staggered waveguide structure disposed between the power splitter and the first end of each chamber, the staggered waveguide structure including:

a first waveguide and a second waveguide;

said first waveguide and said second waveguide each having opposite ends;

wherein said first waveguide is directed with respect to said second waveguide so that they flow away from each other, creating more space for at least one waveguide than if the waveguides were not directed.

19. A device as described in claim 18, wherein in said device, the waveguides begin adjacent to each other and can end up adjacent to each other.

20. A device as described in claim 18, wherein in said device, the waveguides have enough space so that at least one waveguide can have a certain device attached to it where said space was created.

* * * * *